US010370234B2

(12) United States Patent
Bandini et al.

(10) Patent No.: US 10,370,234 B2
(45) Date of Patent: Aug. 6, 2019

(54) FILLING DEVICE FOR FILLING MACHINE

(71) Applicant: SIDEL PARTICIPATIONS S.A.S., Octeville-sur-Mer (FR)

(72) Inventors: Filippo Bandini, Parma (IT); Mattia Cenci, Parma (IT)

(73) Assignee: SIDEL PARTICIPATIONS S.A.S, Octeville-Sur-Mer (FR)

( * ) Notice: Subject to any disclaimer, the term of this patent is extended or adjusted under 35 U.S.C. 154(b) by 0 days.

(21) Appl. No.: 15/367,779

(22) Filed: Dec. 2, 2016

(65) Prior Publication Data

US 2017/0158480 A1 Jun. 8, 2017

(30) Foreign Application Priority Data

Dec. 4, 2015 (EP) ..... 15306936

(51) Int. Cl.
*B67C 3/10* (2006.01)
*B67C 3/12* (2006.01)
(Continued)

(52) U.S. Cl.
CPC ..... *B67C 3/225* (2013.01); *B67C 3/10* (2013.01); *B67C 3/12* (2013.01); *B67C 3/242* (2013.01);
(Continued)

(58) Field of Classification Search
CPC .. B67C 3/225; B67C 3/10; B67C 3/12; B67C 3/242; B67C 3/2614; B67C 3/281
(Continued)

(56) References Cited

U.S. PATENT DOCUMENTS 1,166,607 A * 1/1916 La Porte ..... B65B 39/004 141/250
3,047,032 A * 7/1962 Carter ..... B67C 3/04 141/149
(Continued)

FOREIGN PATENT DOCUMENTS

EP A-179976 5/1986
EP A-616971 9/1994
(Continued)

OTHER PUBLICATIONS

Extended European Search Report issued by the European Patent Office in counterpart European Patent Application No. 15306936.4, dated May 2, 2016.

*Primary Examiner* — Timothy L Maust
*Assistant Examiner* — James R Hakomaki
(74) *Attorney, Agent, or Firm* — Finnegan, Henderson, Farabow Garrett & Dunner LLP

(57) ABSTRACT

A filling device for a filling machine configured to fill receptacles with a pourable product, comprising: a tubular body having a longitudinal axis, defining a central flowing channel for the pourable product, and terminating at a lower end with an axial outlet opening adapted to deliver the pourable product to a receptacle to be filled, wherein the channel includes a tapered-section portion located at a given axial distance from, and above, the outlet opening and tapering towards the outlet opening up to a narrowed-section zone; a shutter movable within the channel; and at least one exhaust conduit arranged on an outer circumference than the channel with reference to the longitudinal axis; wherein the channel includes an enlarged-section portion located immediately below the tapered-section portion, having a larger diameter than the narrowed-section zone, and defining an
(Continued)

expansion chamber receiving a bottom end opening of the exhaust conduit.

20 Claims, 6 Drawing Sheets

(51) Int. Cl.
*B67C 3/22* (2006.01)
*B67C 3/24* (2006.01)
*B67C 3/26* (2006.01)
*B67C 3/28* (2006.01)

(52) U.S. Cl.
CPC ..... *B67C 3/2614* (2013.01); *B67C 3/281* (2013.01); *B67C 2003/228* (2013.01); *B67C 2003/2671* (2013.01)

(58) Field of Classification Search
USPC ..... 141/250
See application file for complete search history.

(56) References Cited

U.S. PATENT DOCUMENTS 3,411,745 A 11/1968 Austin, Jr. et al.
3,604,480 A 9/1971 Reichert et al.
3,870,089 A 3/1975 Laub, III
5,031,673 A * 7/1991 Clusserath ..... B65B 55/10 141/11
5,501,253 A * 3/1996 Weiss ..... B67C 3/2614 141/198
5,634,500 A * 6/1997 Clusserath ..... B67C 3/10 141/44
5,884,677 A * 3/1999 McKaughan ..... B67C 3/10 141/145
6,189,578 B1 * 2/2001 Clusserath ..... B67C 3/10 141/293
6,817,386 B2 11/2004 Tsukano et al.
9,758,361 B2 * 9/2017 Zoni ..... B65C 3/16
2002/0014276 A1 * 2/2002 Clusserath ..... B67C 3/065 141/40
2003/0196721 A1 * 10/2003 Graffin ..... B67C 3/26 141/302
2005/0178466 A1 * 8/2005 Tanikawa ..... B67C 3/2614 141/57
2007/0074783 A1 * 4/2007 Stocchi ..... B67C 3/004 141/264
2010/0037983 A1 * 2/2010 Hiroya ..... B67C 3/2614 141/46
2010/0065150 A1 * 3/2010 Conforti ..... B67C 3/10 141/100

FOREIGN PATENT DOCUMENTS

EP 1411023 A1 4/2004
JP B-2856057 2/1999
JP 2004-136927 5/2004
WO WO-A-2005/019090 3/2005
WO WO 2013/057695 A1 4/2013

* cited by examiner

FILLING DEVICE FOR FILLING MACHINE

CROSS-REFERENCE TO RELATED APPLICATIONS

This application claims the benefit of priority of European Patent Application No. 15306936.4, filed on Dec. 04, 2015, which is incorporated herein by reference.

TECHNICAL FIELD

The present invention relates to a filling device for a filling machine apt to fill receptacles, in particular made up of plastic material, with a pourable product, in particular a still or carbonated pourable product, such as still or sparkling water, soft drinks, beverages, etc.

In addition, the present invention relates to a filling device suitable for operating in aseptic or ultra clean conditions.

BACKGROUND ART

A typical known filling machine used in this sector substantially comprises a carousel conveyor rotating about a vertical axis, a product tank containing the pourable product and carried centrally by the carousel conveyor, and a plurality of filling devices supported by the carousel conveyors in positions radially external with respect to the product tank, connected to the product tank through respective fluidic circuits or lines and conveyed by the carousel conveyor along a circular transfer path.

In particular, the carousel conveyor receives a succession of empty receptacles from an input star wheel and releases the filled receptacles to an output star wheel.

Each filling device basically comprises a support device, adapted to receive and retain a respective receptacle in a vertical position, and a filling valve for feeding a given volume of pourable product into the receptacle as the filling device travels along the circular transfer path by following the rotary movement imparted to the carousel conveyor.

An example of known filling valve is disclosed in EP-A-1411023 and basically comprises:

- a vertical tubular body fixed to the peripheral portion of the carousel conveyor and defining a central flowing channel for feeding the pourable product to a respective receptacle to be filled;
- a shutter engaging in a sliding manner the tubular body and movable within the flowing channel to allow or prevent flow of the pourable product towards the respective receptacle; and
- actuator means to move the shutter within the channel of the tubular body.

In particular, the tubular body presents a longitudinal axis parallel to the carousel conveyor axis and terminates at a lower end with an axial outlet opening adapted to contact in use a top end mouth of a receptacle to be filled.

The channel of the tubular body comprises a tapered-section portion located at a given axial distance from, and above, the outlet opening and tapering towards the outlet opening itself up to a minimum-diameter section. From this point down to a position close to the outlet opening, the channel comprises an axial bottom end portion having a constant diameter equal to the minimum diameter of the tapered-section portion.

The shutter is movable within the channel of the tubular body between a lowered closed position, in which the shutter sealingly closes the tapered-section portion of the channel itself and interrupts flowing of the pourable product towards the axial bottom end portion and the outlet opening, and a raised open position, in which the shutter delimits with the tapered-section portion an annular passage communicating with the axial bottom end portion and the outlet opening.

The filling valve further comprises three conduits formed within the tubular body and arranged on outer circumferences than the central channel with reference to the longitudinal axis of the filling valve:

- one exhaust conduit for discharging the gas present in the receptacle during filling thereof with the pourable product;
- one decompression conduit for depressurizing the receptacle at the end of the filling, for carbonated products; and
- one air conduit for forcing the pourable product present in the axial bottom end portion of the channel to fall down into the receptacle.

In case of carbonated pourable products, the exhaust conduit is also used for pressurizing the receptacle at a desired pressure value, higher than the atmospheric pressure, prior to starting the actual filling of the receptacle itself.

The filling device disclosed in EP-A-1411023 has the following drawbacks.

First of all, the restricted passage (axial bottom end portion) connecting the tapered-section portion of the channel to the outlet opening tends to increase turbulence of the product delivered to the receptacle and to create vortices, with possible formation of undesired foam.

Moreover, due to the presence of such restricted passage, it is necessary to provide an additional air conduit and an additional air circuit to cause the product possibly left in the axial bottom end portion of the channel to fall down into the receptacle.

Finally, by using the same conduit for discharging the gas present in the receptacle during filling and for pressurizing the receptacle itself may cause some foam possibly left in the bottom portion of such conduit at the end of one filling operation to be delivered to the next receptacle during the following pressurizing step.

DISCLOSURE OF INVENTION

It is therefore an object of the present invention to provide a filling device for filling machine, which allows to overcome, in a straightforward and low-cost manner, the drawbacks associated with the filling devices of known type.

According to the present invention, there is provided a filling device as claimed in claim 1.

BRIEF DESCRIPTION OF THE DRAWINGS

A preferred embodiment is hereinafter disclosed for a better understanding of the present invention, by mere way of non-limitative example and with reference to the accompanying drawings, in which.

BEST MODE FOR CARRYING OUT THE INVENTION

Figure 1:
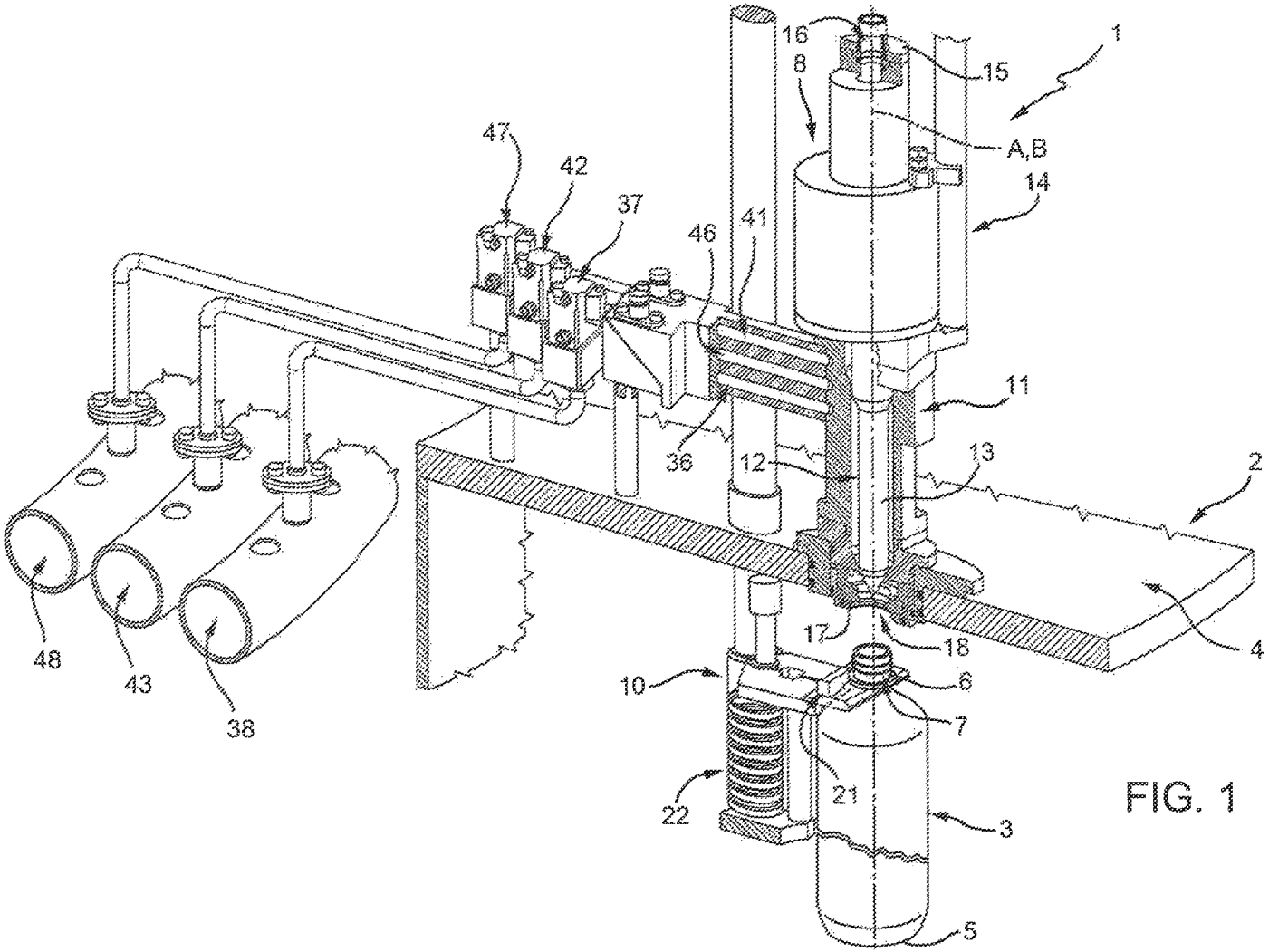
FIG. 1 shows a partially sectioned perspective view of a filling device according to the present invention, prior to starting a filling operation of a receptacle and with parts removed for clarity.

Number 1 in the enclosed Figures indicates as a whole a filling device according to the present invention, which is adapted to be incorporated in a filling machine 2 (only partially shown in FIGS. 1 and 2) in aseptic or ultra-clean conditions (known per se and not shown) for filling receptacles 3, in particular made up of plastic material, with a pourable product, in particular a pourable food product, such as a still or a carbonated beverage.

Filling machine 2 is typically fed with sterilised empty receptacles 3 and fills the latter with the pourable product in aseptic conditions. For this purpose, filling machine 2 typically comprises a product tank (known per se and not shown) containing the pourable product, a carousel conveyor 4 (only partially shown in FIGS. 1 and 2) rotating about a vertical axis and protrudingly bearing on its peripheral portion a plurality of filling devices 1 (only one shown in the enclosed Figures) for filling respective receptacles 3 during rotation of the carousel conveyor 4 itself.

In the example shown in FIGS. 1 to 5, each receptacle 3 is defined by a bottle having a longitudinal axis A and which is advanced in a vertical position by the carousel conveyor 4. In particular, each receptacle 3 is inferiorly bounded by a bottom wall 5, substantially perpendicular to axis A, and has a top neck 6 coaxial with the axis A itself and defining an inlet/outlet mouth for the pourable product; the neck 6 is preferably equipped with a threaded surface 7 designed to allow the closing off by a screw cap (known per se and not shown).

With reference to the enclosed Figures, each filling device 1 comprises a filling valve 8, adapted to control feeding of the pourable product, and support means 10 adapted to support one respective receptacle 3 below the filling valve 8 and in a vertical position, in which such receptacle 3 has its neck 6 placed in contact with the filling valve 8 to receive from the latter the pourable product.

Valve 8 basically comprises:

- a vertical tubular body 11 fixed to the peripheral portion of the carousel conveyor 4 and defining a central flowing channel 12 for feeding the pourable product to the respective receptacle 3;
- a shutter 13 engaging in a sliding manner tubular body 11 and movable within channel 12 to allow or prevent flow of the pourable product towards the respective receptacle 3; and
- actuator means 14 arranged completely externally to tubular body 11 and magnetically coupled to shutter 13 to move the latter within channel 12.

In particular, tubular body 11 has a longitudinal axis B, parallel to the rotation axis of carousel conveyor 4, and terminates at its upper end 15 with an axial inlet opening 16, for receiving the pourable product from the product tank, and at its lower end 17 with an outlet opening 18 for feeding the pourable product to the respective receptacle 3.

More specifically, axial inlet opening 16 of upper end 15 is directly connected to a product conduit 19 extending from the tubular body 11 to the product tank.

Lower end 17 of tubular body 11 is adapted to contact in use the top neck 6 of the receptacle 3 to be filled so as to put the inlet/outlet mouth of the receptacle 3 itself in direct connection with outlet opening 18. In greater details, lower end 17 comprises an annular gasket 20 adapted to define an abutment for the top neck 6 of the respective receptacle 3 and to sealingly close the latter during filling; in this way, the interior of the receptacle 3 is maintained in a sealed condition during filling with the pourable product.

As clearly visible in FIGS. 1 to 5, support means are configured to receive and retain a relative receptacle 3 in a suspended position with its axis A coaxial to axis B of the filling valve 8. In particular, support means 10 comprise a gripping member 21, arranged below filling valve 8 and configured to retain a relative receptacle 3 by the neck 6, and actuator means 22 for moving the gripping member 21, and therefore the respective receptacle 3, towards and away from annular gasket 20 of lower end 17 of tubular body 11.

Figure 3:
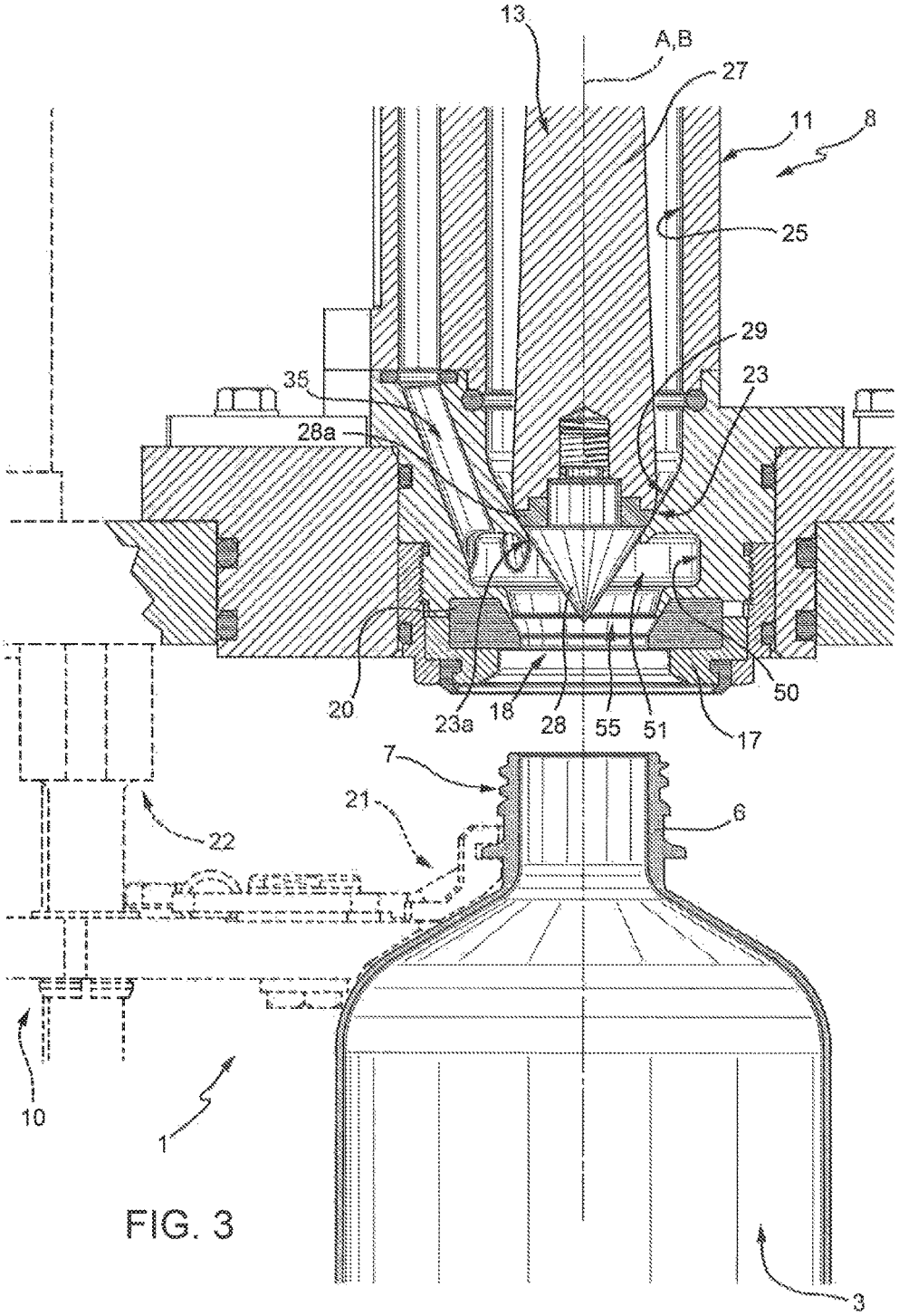
FIG. 3 shows a larger-scale, partially-sectioned front view of a main part of the filling device of FIG. 2.
Figure 4:
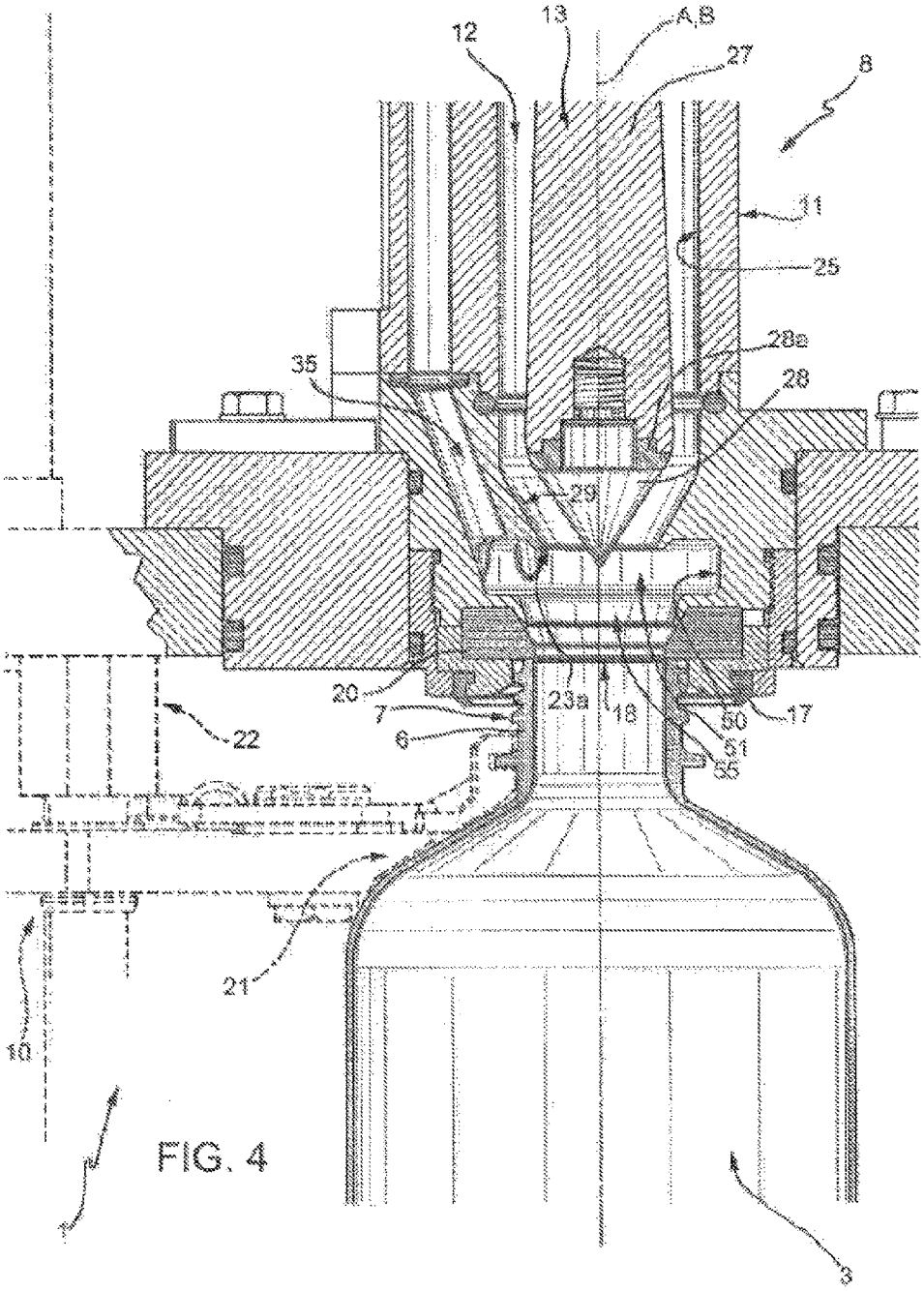
FIGS. 4 and 5 are analogous to FIG. 3 and show the main part of the filling device during the filling operation of the receptacle and at the end of such filling operation, respectively.
Figure 5:
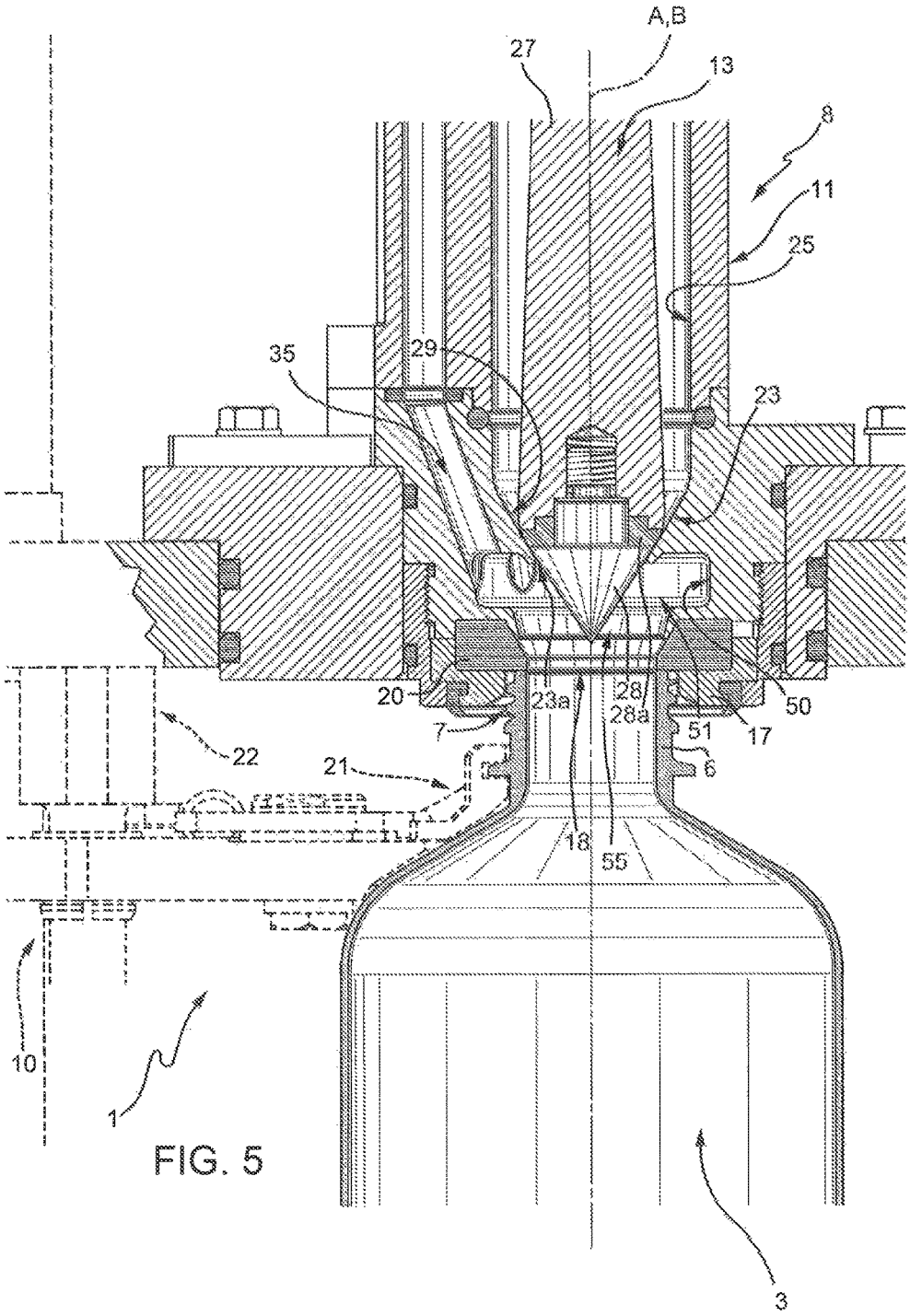
Figure 8:
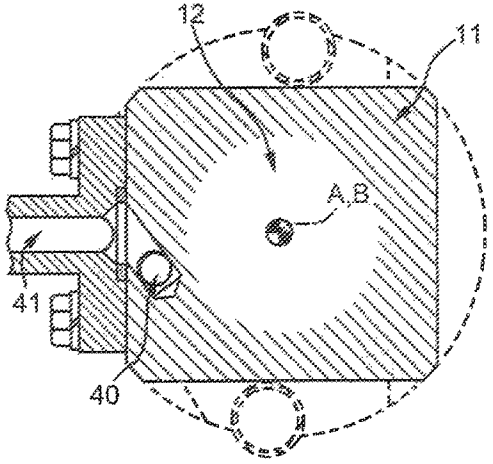
FIG. 8 is a larger-scale section along line VIII-VIII of FIG. 2.
Figure 7:
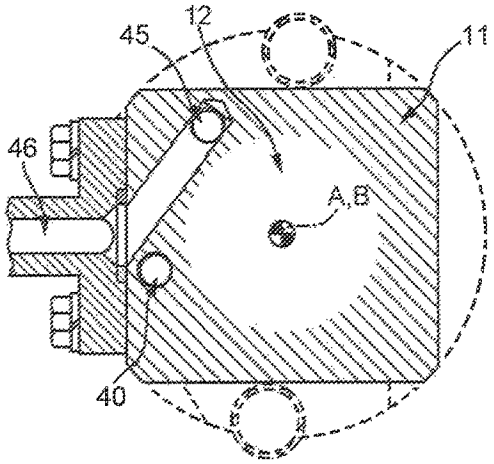
FIG. 7 is a larger-scale section along line VII-VII of FIG. 2.
Figure 6:
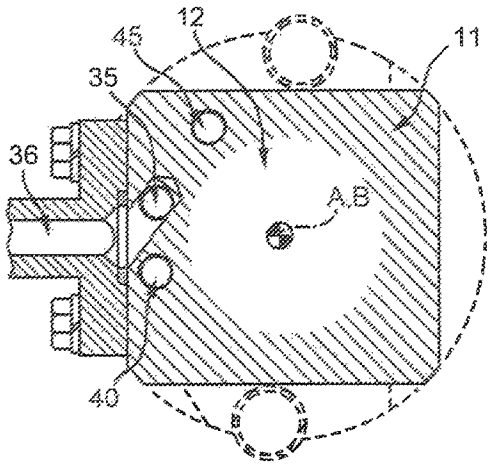
FIG. 6 is a larger-scale section along line VI-VI of FIG. 2.

With particular reference to FIGS. 3 to 5, channel 12 comprises, in the vicinity of outlet opening 18, a tapered-section portion 23 located at a given axial distance from, and above, the outlet opening 18 itself and tapering towards the latter up to a narrowed-section zone 23*a*. More specifically, tapered-section portion 23 defined by a frustum-conical inner surface of tubular body 11, which tapers from an upper cylindrical inner surface 25 of the tubular body 11 itself. Narrowed-section zone 23*a* represents the minimum-diameter zone of tapered-section portion 23.

With reference to FIGS. 1 to 5 and 9, shutter 13 is coaxially mounted within channel 12 of tubular body and comprises a substantially cylindrical main portion 27, sliding within the tubular body 11 itself, and a pointed closing head 28, axially protruding from main portion 27 and configured to cooperate in a fluid-tight manner with tapered-section portion 23 of channel 12.

In particular, closing head 28 terminates with a conical surface, which is complementary to the inner frustum-conical surface of tubular body 11 defining tapered-section portion 23 and is configured to cooperate in use with such surface to sealingly close is fluidic connection of filling valve 8 with the respective receptacle 3. To this aim, the conical surface of closing head 28 is provided with an annular gasket 28*a* directly contacting in use the surface of tubular body 11 delimiting tapered-section portion 23 of channel 12.

Shutter 13 is movable within channel 12 between a lowered closed position (FIGS. 1, 2, 3 and 5), in which the shutter 13 sealingly closes the tapered-section portion 23 of the channel 12 itself and interrupts flowing of the pourable product towards the outlet opening 18, and a raised open position (FIG. 4), in which the shutter 13 delimits with the tapered-section portion 23 an annular passage 29 communicating with the outlet opening 18.

Figure 2:
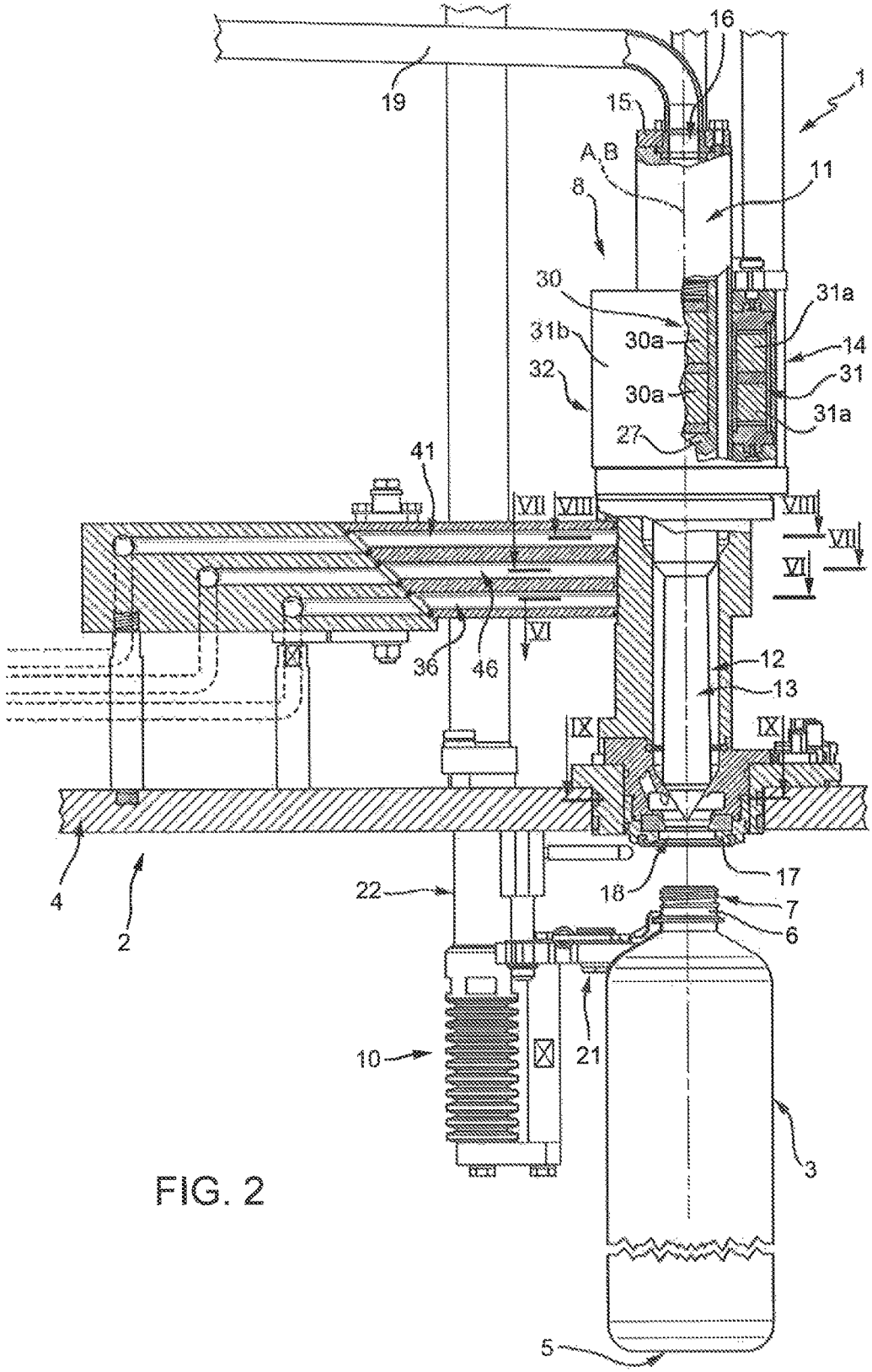
FIG. 2 shows a larger-scale, partially sectioned front view of the filling device of FIG. 1, with parts removed for clarity.

With particular reference to FIG. 2, main portion 27 of shutter 13 comprises at least one permanent-magnet unit 30 magnetically coupled with at least one permanent-magnet unit 31 of actuator means 14.

More specifically, permanent-magnet unit 30 comprises at least two permanent magnets 30*a* arranged adjacent to one another with identical magnetic poles facing axially. The permanent magnets 30*a* are conveniently incorporated within main portion 27 of shutter 13.

In a completely analogous way, permanent-magnet unit 31 comprises at least two permanent magnets 31*a* arranged adjacent to one another with identical magnetic poles facing axially, and oriented, with respect to the permanent magnets 30*a* of shutter 13, with different magnetic poles reciprocally facing radially. In particular, permanent-magnet unit 31 also comprises a cylindrical casing 31*b* internally housing permanent magnets 31*a*.

Actuator means 14 comprise, in a known manner, a magnetic movable member 32, coaxially coupled in a sliding manner onto an outer surface 33 of tubular body 11 and provided with the permanent-magnet unit 31, and a driving linear actuator (know per se and not shown) for displacing movable member 32 and, through magnetic attraction, shutter 13 along axis B.

With reference to the enclosed Figures, tubular body 11 also defines:

- an exhaust conduit 35, which is connected, through an exhaust circuit 36 and an ON/OFF valve 37, to an annular chamber 38 (known per se and only partially shown) formed in the carousel conveyor 4 and communicating in a known manner with the outer atmosphere in a switchable manner;
- a pressurizing conduit 40, which is connected, through a pressurization circuit 41 and an ON/OFF valve 42, to an annular chamber 43 (known per se and only partially shown) formed in the carousel conveyor 4 and filled with a pressurization fluid, such as carbon dioxide; and
- a decompression conduit 45, which is connected, through a decompression circuit 46 and an ON/OFF valve 47, to an annular discharge chamber 48 (known per se and only partially shown).

In particular, exhaust conduit 35 used for exhausting the gas, typically air and/or $CO_2$, present within the interior of the receptacle 3 during filling, when the latter is carried out in a sealed condition.

Pressurizing conduit 40 is used for pressurizing the receptacle 3 to be filled at a pressure higher than the atmospheric pressure; this conduit is typically used for receptacles 3 to be filled with a carbonated liquid.

Decompression conduit 45 is used for depressurizing the filled receptacle 3 at the end of filling; even this conduit is typically used for receptacles 3 filled under pressure with a carbonated liquid.

Conduits 35, 40 and 45 are all formed within tubular body 11 and are all distinct from one another.

Each one of these conduits 35, 40, 45 is arranged on one side of channel 12 and on an outer circumference than channel 12 with reference to axis A. More specifically and as clearly visible in FIG. 9, all these conduits 35, 40, 45 are arranged on a common outer circumference C than the channel 12 with reference to axis B.

According to an important aspect of the present invention, channel 12 of tubular body 11 also comprises an enlarged-section portion 50 (FIGS. 3 to 5 and 9) located immediately below tapered-section portion 23, having a larger diameter than narrowed-section zone 23*a* with reference to axis B and defining an expansion chamber 51 also receiving bottom end openings of respective conduits 35, 40, 45.

In practice, all conduits 35, 40, 45 debouch into expansion chamber 51 of channel 12 through respective bottom end openings.

Figure 9:
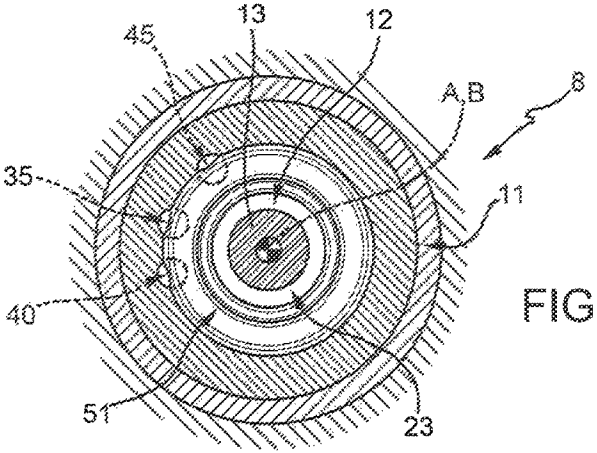
FIG. 9 is a larger-scale section along line IX-IX of FIG. 2.

As shown in particular in FIG. 9, all conduits 35, 40, 45 are arranged on circumference C around channel 12 and axis B.

In the particular example shown in the enclosed Figures, expansion chamber 51 extends from axis B up to the circumference C, on which conduits 35, 40, 45 are located.

The diameter of enlarged-section portion 50 of channel 12 is preferably constant along the entire axial height of the enlarged-section portion 50 itself.

Channel 12 further comprises a reduced-section end portion 55 connecting enlarged-section portion 50 to outlet opening 18 and having a smaller diameter than the enlarged-section portion 50 itself. In particular, the diameter of the reduced-section portion 55 of channel 12 decreases towards outlet opening 18.

Operation of filling device 1 will now be described with reference to one receptacle 3 and as of the instant in which such receptacle 3 is fed to filling machine 2 in order to be filled with a pourable product.

In particular, the receptacle 3 is retained at its neck 6 by the gripping member 21 in a vertical position, i.e. with its axis A coaxial to the axis B of the filling valve 8 and its neck 6 located in an upper position than its bottom wall 5 (FIGS. 2 and 3). The receptacle 3 may be also supported at its bottom wall 5 by a respective lower support plate (not shown).

In this condition, shutter 13 of filling valve 8 is set in the lowered closed position within channel 12 of tubular body 11 of filling valve 8. In an analogous manner, all valves 37, 42, 47 of exhaust circuit 36, pressurization circuit 40 and decompression circuit 46 are set in a closed condition.

In the case in which the pourable product to be delivered is a carbonated liquid, the first step to perform is to couple the receptacle 3 to the tubular body 11 in a fluid-tight manner. This can be achieved by activating actuator means 22 so as to raise the gripping member 21 towards the filling valve 8 up to bring the neck 6 of the receptacle 3 into contact with the gasket 20 of lower end 17 of tubular body 11.

At this point, the receptacle 3 is subjected to a pressurization step. To this end, valve 41 of pressurization circuit 40 is opened and is maintained in that condition up to the moment in which pressure in the receptacle 3 reaches a desired pressure value, which depends on the particular type of product to be delivered and may amount up to 6 bar; this desired pressure value corresponds to the pressure of the product in the product tank and defines the requested condition for starting the filling operation. Then, the valve 41 is closed.

The shutter 13 is then moved to its raised open position (FIG. 4), in which it allows flow of the pourable product through annular passage 29 towards the receptacle 3. This movement is achieved by activating the linear actuator controlling magnetic movable member 32; by effect of the magnetic coupling between shutter 13 and magnetic movable member 32, the translating motion of this latter member determines a corresponding axial translating motion of the shutter 13 within channel 12 of tubular body 11.

At the same time, the valve 37 of exhaust circuit 36 is opened, so that the gas present in the receptacle is discharged during the filling with the pourable product.

This step ends when the product reaches the desired level in the receptacle 3.

Thanks to the presence of the expansion chamber 51 immediately below the narrowed-section zone 23*a* of the channel 12, the gas exiting the bottle during filling can expand during the filling operation, so that turbulence and formation of vortices are attenuated; this allows to fill the receptacle 3 at high speed with a reduced formation of foam.

At the end of the filling, the shutter 13 is moved to its initial lowered closed position (FIG. 5) and the valve 37 of the exhaust circuit 36 is closed.

The next step is the decompression of the receptacle 3, which is achieved by opening the valve 47 and therefore connecting the receptacle 3 itself with decompression circuit 46.

In the case in which the pourable product delivered to the receptacle 3 is a non-carbonated liquid, the pressurization and decompression steps are not performed. In addition, the actual filling may occur without bringing the receptacle 3 into contact with the gasket 20 of the tubular body 11.

The advantages of filling device 1 according to the present invention will be clear from the foregoing description.

In particular, thanks to the presence of the enlarged-section portion 50 immediately below the tapered-section portion 23 of the channel 12, the gas exiting the bottle during filling can expand during the filling operation, so that turbulence and formation of vortices are quite limited; this allows to fill the receptacle 3 at high speed with a reduced formation of foam.

Moreover, the use of distinct conduits 35, 40 for discharging the gas present in the receptacle 3 during filling thereof and for pressurizing the receptacle 3 before filling avoids any risk that possible residues of product present in the bottom terminal part of the exhaust conduit 35 at the end of filling may fall in the next receptacle 3 during the following pressurizing step. And even if such residues are present at the terminal part of the exhaust conduit 35, which can be caused by small quantities of foam in the gas exiting the bottle during filling, any such residues or foam fall into the enlarged-section portion 50 and not into underlying bottle.

Clearly, changes may he made to filling device 1 as described herein without, however, departing from the scope of protection as defined in the accompanying claims.

The invention claimed is:

1. A filling device for a filling machine configured to fill receptacles with a pourable product, the filling device comprising:

a tubular body having a longitudinal axis, defining a central flowing channel for the pourable product and terminating at a first end with an axial outlet opening configured to deliver the pourable product to a receptacle, wherein the channel includes a tapered-section portion tapering inward from a first end thereof to a narrowed-section zone at a second end thereof, the narrowed-section zone spaced apart from the outlet opening;

a shutter movable within the channel between a closed position, in which the shutter sealingly closes the tapered-section portion of the channel and interrupts flow of the pourable product towards the outlet opening, and an open position, in which the shutter delimits, with the tapered-section portion, an annular passage communicating with the outlet opening; and at least one exhaust conduit formed within the tubular body, wherein the exhaust conduit is arranged on one side of the channel and on a circumference extending about the longitudinal axis, the channel located within the circumference, wherein the channel includes:

an enlarged-section portion located immediately adjacent to the narrowed-section zone of the tapered-section portion, and a reduced-section end portion extending between the enlarged-section portion and the outlet opening, the reduced-section end portion tapering inward from a first end thereof to the outlet opening of the tubular body at a second end thereof, wherein the enlarged-section portion has a larger diameter than the narrowed-section zone of the tapered-section portion and the first end of the reduced-section end portion and defines an expansion chamber, wherein the expansion chamber includes:

a lower surface, an upper surface parallel to the lower surface, and an outer circumferential wall perpendicular to the lower surface and the upper surface, the outer circumferential wall interconnecting the lower surface and the upper surface and defining a constant height of the expansion chamber, wherein the at least one exhaust conduit includes a lower exhaust conduit end configured to open into the expansion chamber, and wherein the lower surface of the expansion chamber extends in a radial direction from the outer circumferential wall towards the longitudinal axis, the lower surface of the expansion chamber underlying the lower exhaust conduit end.

2. The filling device as claimed in claim 1, wherein the diameter of the enlarged-section portion of the channel is constant along the entire axial height of the enlarged-section portion.

3. The filling device as claimed in claim 1, further comprising:

at least one pressurization conduit configured to pressurize the receptacle to be filled at a pressure higher than an atmospheric pressure, the pressurization conduit being formed within the tubular body and being distinct from the exhaust conduit, wherein the pressurization conduit is arranged on the one side of the channel and on a second circumference extending about the longitudinal axis, the channel located within the second circumference, and wherein the enlarged-section portion is configured to receive an end of the pressurization conduit.

4. The filling device as claimed in claim 3, wherein both the exhaust conduit and pressurization conduit are arranged on a common circumference extending about the channel and the longitudinal axis.

5. The filling device as claimed in claim 3, further comprising:

at least one decompression conduit configured to depressurize a receptacle filled with the pourable product, the decompression conduit being formed within the tubular body and being distinct from the exhaust conduit and the pressurization conduit, wherein the decompression conduit is arranged on the one side of the channel and on a third circumference extending about the longitudinal axis, the channel located within the third circumference, and wherein the enlarged-section portion is configured to receive an end of the decompression conduit.

6. The filling device as claimed in claim 5, wherein the exhaust conduit, pressurization conduit, and decompression conduit are arranged on a common circumference extending about the channel and the longitudinal axis.

7. The filling device as claimed in claim 1, further comprising:

a support device configured to receive and retain the receptacle and to move the receptacle towards and away from the outlet opening of the tubular body.

8. The filling device as claimed in claim 1, further comprising:

a first magnetic device carried by the shutter; and a second magnetic device arranged on an outer surface of the tubular body, wherein the second magnetic device is configured to move the shutter along the longitudinal axis between the open position and the closed position via magnetic coupling between the first magnetic device and the second magnetic device.

9. The filling device as claimed in claim 1, wherein the shutter is configured to extend into the reduced-section end portion when the shutter is in the closed position.

10. The filling device as claimed in claim 1, wherein the first end of the reduced-section end portion forms a central opening within the lower surface of the expansion chamber.

11. The filling device as claimed in claim 10, wherein the lower surface of the expansion chamber extends radially, with respect to the longitudinal axis, between the cylindrical side-wall and the first end of the reduced-section end portion and is configured to prevent residue from the exhaust conduit from falling into the reduced-section end portion.

12. The filling device as claimed in claim 1, further comprising an annular gasket situated around at least a portion of the reduced-section end portion, wherein the annular gasket is configured to abut at least a portion of the receptacle such that the receptacle is prevented from passing through the reduced-section end portion and into the enlarged-section portion.

13. A filling device for a filling machine configured to fill receptacles with a pourable product, the filling device comprising:

a filling valve configured to control feeding of the pourable product and having a tubular body extending along a longitudinal axis, wherein the tubular body has an outlet opening at an axial end thereof;

a support configured to support a receptacle coaxially with the outlet opening of the tubular body;

a channel defined within the tubular body and including a tapered-section portion tapering inward from a first end thereof to a narrowed-section zone at a second end thereof, the tapered-section portion spaced apart from the outlet opening;

an exhaust conduit formed in the tubular body and arranged on one side of the channel; and a shutter slideably and coaxially mounted within the channel and provided with a closing head, the closing head having a sealing surface configured to seal the tapered-section portion of the channel, wherein the shutter is configured to move within the channel between a closed position, in which the closing head of the shutter closes the tapered-section portion to interrupt flow of the pourable product towards the outlet opening, and an open position in which the shutter delimits, with the tapered-section portion, an annular passage communicating with the outlet opening, wherein the channel includes:

an enlarged-section portion located immediately adjacent to the narrowed-section zone of the tapered-section portion, and a reduced-section end portion extending between the enlarged-section portion and the outlet opening, the reduced-section end portion tapering inward from a first end thereof to the outlet opening of the tubular body at a second end thereof, wherein the enlarged-section portion has a larger diameter than the narrowed-section zone of the tapered-section portion and the first end of the reduced-section end portion for preventing residue from the exhaust conduit from falling into the receptacle, wherein the enlarged-section portion defines an expansion chamber, wherein the expansion chamber includes:

a lower surface, an upper surface parallel to the lower surface, and an outer circumferential wall perpendicular to the lower surface and the upper surface, the outer circumferential wall interconnecting the lower surface and the upper surface and defining a constant height of the expansion chamber, wherein the exhaust conduit includes a lower exhaust conduit end configured to open into the expansion chamber, and wherein the lower surface of the expansion chamber extends in a radial direction from the outer circumferential wall towards the longitudinal axis, the lower surface of the expansion chamber underlying the lower exhaust conduit end.

14. The filling device as claimed in claim 13, further comprising:

a main portion of the shutter having a permanent magnet unit provided therein; and an actuator having a magnetic movable member coaxially and slideably connected to an outer surface of the tubular body, the actuator configured to move the shutter between the closed position and the open position via magnetic coupling between the permanent magnet unit and the magnetic movable member.

15. The filling device as claimed in claim 13, wherein the tubular body includes an annular gasket positioned about the outlet opening and wherein the support comprises:

a gripping member configured to grip a neck of the receptacle such that a longitudinal axis of the receptacle is arranged coaxially with the longitudinal axis of the tubular body; and a gripping member actuator configured to move the gripping member and the receptacle into engagement with and away from the annular gasket, wherein the shutter is configured to be in the open position and the exhaust conduit is configured to discharge gas present in the receptacle during filling of the receptacle when the receptacle is moved by the gripping member actuator into engagement with the annular gasket.

16. The filling device as claimed in claim 13, wherein the first end of the reduced-section end portion forms an opening within the lower surface of the expansion chamber.

17. The filling device as claimed in claim 13, wherein the expansion chamber has a constant diameter along the constant height for allowing expansion of gas and thereby attenuating turbulence and foaming when feeding the pourable product into the receptacle.

18. A filling device for a filling machine configured to fill receptacles with a pourable product, the filling device comprising:

a filling valve configured to control feeding of the pourable product and having a tubular body, the tubular body extending along a longitudinal axis and having an outer surface and an outlet opening at an axial end thereof;

a support configured to support a receptacle coaxially with the outlet opening of the tubular body;

a channel defined within the tubular body and including a tapered-section portion tapering inward from a first end thereof to a narrowed-section zone at a second end thereof, the narrowed-section zone spaced apart from the outlet opening of the tubular body;

an exhaust conduit formed in the tubular body and arranged on one side of the channel, the exhaust conduit having a lower exhaust conduit end;

a valve connected to the exhaust conduit and configured to assume an open position in which gas present in the receptacle is allowed to be discharged during filling of the receptacle, and a closed position in which gas discharge through the exhaust conduit is prevented;

a shutter slideably and coaxially mounted within the channel and including a main portion and a closing head, the closing head having a sealing surface configured to seal the tapered-section portion of the channel, the shutter configured to move within the channel between:

a closed position, in which the closing head of the shutter closes the tapered-section portion to interrupt flow of the pourable product towards the outlet opening, wherein the shutter is configured to be in the closed position thereof when the valve connected to the exhaust conduit is in the closed position thereof, and an open position, in which the shutter delimits, with the tapered-section portion, an annular passage fluidly communicating with the outlet opening, wherein the shutter is configured to be in the open position thereof when the valve connected to the exhaust conduit is in the open position thereof;

a permanent magnet unit provided in the main portion of the shutter; and an actuator including a magnetic movable member coaxially and slideably connected to the outer surface of the tubular body, the actuator configured to move the shutter between the closed position and the open position via magnetic coupling between the permanent magnet unit and the magnetic movable member, wherein the channel includes:

an enlarged-section portion located immediately adjacent to the narrowed-section zone of the tapered-section portion; and a reduced-section end portion extending between the enlarged-section portion and the outlet opening, the reduced-section end portion tapering inward from a first end thereof to the outlet opening of the tubular body at a second end thereof, wherein the enlarged-section portion has a larger diameter than the narrowed-section zone of the tapered-section portion and the first end of the reduced-section end portion for preventing residue from the exhaust conduit from falling into the receptacle, wherein the enlarged-section portion defines an expansion chamber having a lower surface, an upper surface parallel to the lower surface, and an outer circumferential wall extending about the longitudinal axis and upon which the lower exhaust conduit end of the exhaust conduit is arranged, the expansion chamber defining an axial height and a constant diameter along the axial height for allowing expansion of gas and thereby attenuating turbulence and foaming when feeding the pourable product into the receptacle, and wherein the lower surface of the expansion chamber extends in a radial direction from the outer circumferential wall towards the longitudinal axis, the lower surface of the expansion chamber underlying the lower exhaust conduit end to thereby prevent the residue from the pourable product in the exhaust conduit from falling into the receptacle.

19. The filling device as claimed in claim 18, wherein the tubular body includes an annular gasket positioned about the outlet opening, and wherein the support comprises:

a gripping member configured for gripping a neck of the receptacle such that a longitudinal axis of the receptacle is arranged coaxially with the longitudinal axis of the tubular body; and a gripping member actuator configured for moving the gripping member and the receptacle into engagement with and away from the annular gasket, wherein the shutter is configured to be in the open position and the valve connected to the exhaust conduit is configured to be in the open position when the receptacle is moved by the gripping member actuator into engagement with the annular gasket.

20. The filling device as claimed in claim 18, wherein the first end of the reduced-section end portion forms an opening within the lower surface of the expansion chamber.

* * * * *